US005467982A

United States Patent [19]

Tseng

[11] Patent Number: 5,467,982

[45] **Date of Patent: * Nov. 21, 1995**

[54] TENNIS RACKET

[76] Inventor: Kuni Tseng, 6F-1, No. 342, Keelung Road, Sec. 1, Taipei, Taiwan

[ * ] Notice: The portion of the term of this patent subsequent to Aug. 21, 2011, has been disclaimed.

[21] Appl. No.: 80,888

[22] Filed: Jun. 22, 1993

[51] Int. Cl.[6] ..... A63B 49/02

[52] U.S. Cl. ..... 273/73 C; 273/73 D

[58] Field of Search ..... 273/73 R, 73 D

[56] References Cited

U.S. PATENT DOCUMENTS

| | | | |
|---|---|---|---|
| 5,005,834 | 4/1991 | Ferrari et al. | 273/73 C |
| 5,192,072 | 3/1993 | Hang | 273/730 X |
| 5,209,472 | 5/1993 | Tseng | 273/73 C |
| 5,234,657 | 8/1993 | Hong | 273/73 RX |

FOREIGN PATENT DOCUMENTS

| | | | |
|---|---|---|---|
| 2196537 | 5/1988 | United Kingdom | 273/73 D |

*Primary Examiner*—Vincent Millin
*Assistant Examiner*—Raleigh W. Chiu
*Attorney, Agent, or Firm*—Pro-Techtor International

[57] ABSTRACT

A tennis racket is formed with a plurality of transverse grooves extending from one face around the frame to the opposite face. The grooves are distributed along the periphery, but are intermittent at four corners of the frame. A single longitudinal groove extends circumferentially at substantially the center lone on the outside face of the frame, and crosses over all transverse grooves. At the corners of the frame, a series of stringing holes are formed. The frame is provided with corresponding bumps comprising a substrate having a central longitudinal recessed channel and a plurality of discrete stringing tubes in paris suspended along opposing longitudinal edges of the substrate. With connecting guide channels extending between the two tubes of each pair. Outside of this region series of central stringing tubes are suspended from the recessed channel.

5 Claims, 5 Drawing Sheets

TENNIS RACKET

FIELD OF THE INVENTION

Figure 1:
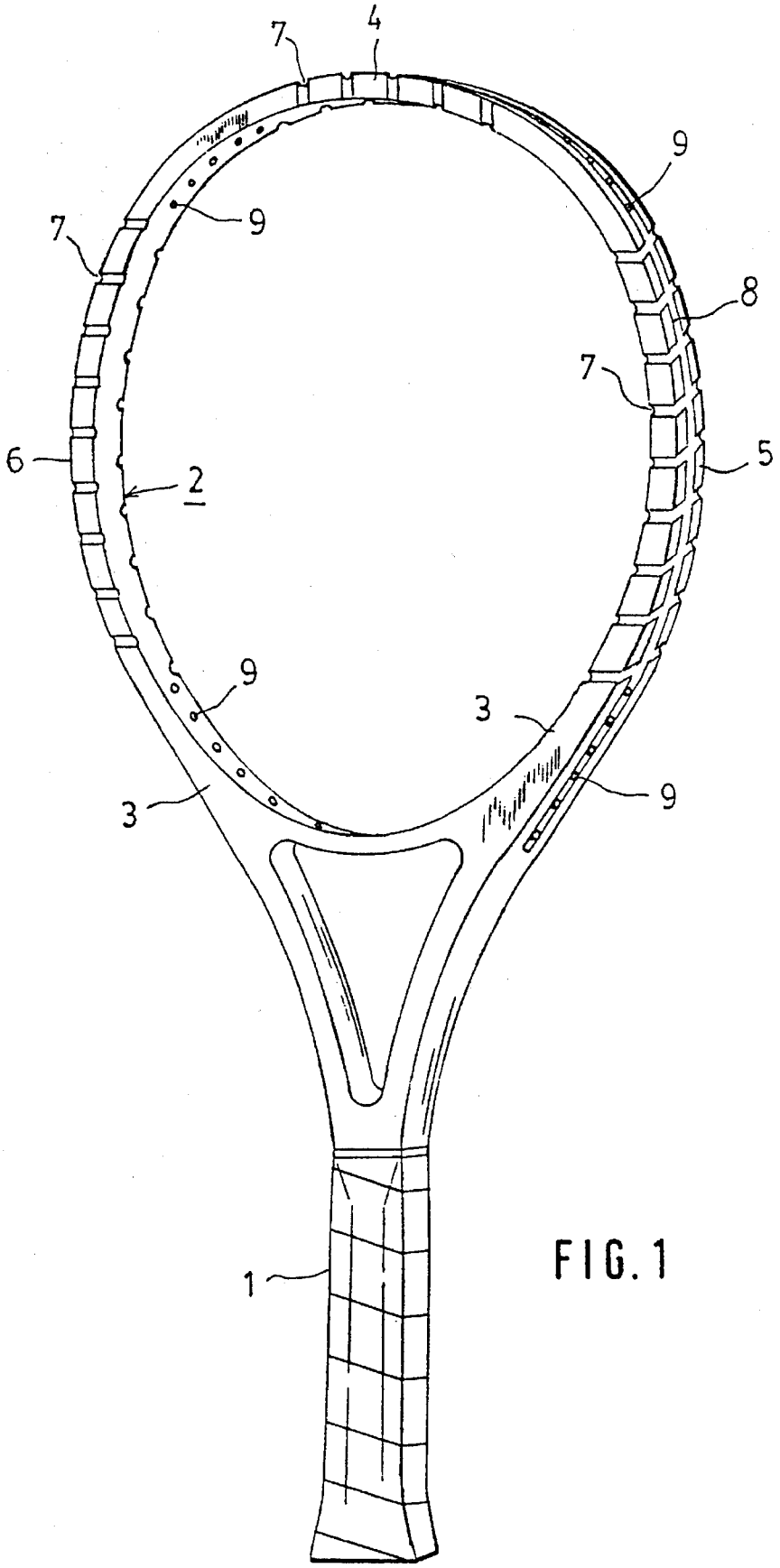

This invention relates to a tennis racket, particularly to a racket with a frame having a central longitudinal groove in its outer surface and a plurality of transverse grooves around the exposed surface.

BACKGROUND OF THE INVENTION

German Utility Model G 77 11 227.7 disclosed a racket in which a plurality of guide grooves are formed around its frame. The frame is 13 is subject to a bad rebound effect due to the fact that the strings pass directly over the frame. U.S. Pat. No. 519,2072 disclosed a racket having its frame provided with a predetermined number of recess cuts, each of which is used to receive therein a stringing tube of a stringing element with shoulders at opposite sides. When this element is mounted onto the elliptical frame, the straight shoulders are inevitably so bulged that they cannot snugly fit over the frame.

SUMMARY OF THE INVENTION

One object of this invention is to provide a tennis racket to overcome the aforementioned drawbacks, in which the racket comprises a shaft and a substantially elliptical frame with the shoulders at lower ends of both lateral portions converging into said shaft,. The racket is characterized in that the top and opposing lateral portions of said frame are formed with a plurality of transverse grooves extending from one face that is parallel with the striking surface created by the interwoven strings, around said frame to the opposite face. A single longitudinal groove extends circumferentially at substantially the center line of the outside surface of said frame from said shoulder at one lateral portion crossing over said transverse grooves to said shoulder at another lateral portion. A series of string holes passes through said frame at the corner portions where the transverse grooves are absent.

Another object of this invention is to provide a bumper into said shaft 1. The distinguishing characteristics of this invention include the fact that top portion 4 and both lateral portions, i.e., right-hand side portion 5 and left-hand side portion 6, are formed with a plurality of transverse grooves 7. The grooves 7 from one face that is parallel with the striking surface formed by the strings (referred to FIG. 5) i.e., at the front side on the drawing, around the outside of said frame 2 to the opposite face, i.e., at the back side on the drawing. The transverse grooves 7 are distributed along the periphery of said frame 2, and the number of the grooves 7 is a matter of choice. Fir example, there are five on the top portion 4 and nine on lateral portions 5, 6 as shown, but these numbers can vary.

At four corners of the frame, namely on the regions between said top portion 4 and both lateral portions 5 and 6, respectively, and on the regions corresponding to two shoulders 3, 3 the distribution of said grooves 7 is intermittent and referred to herein as without transverse grooves.

A single longitudinal groove 8 extends from said shoulder 3 at one lateral portion around the circumference at substantially the center line of the outside of said frame 2 to said shoulder 3 at the other lateral portion, crossing over all of said transverse grooves 7. On said longitudinal groove 8, in the parts corresponding to said regions without transverse grooves, are provided series of central stringing holes 9 pass through said frame 2 from outside to inside. The number of holes 9 is a matter of choice.

Figure 2:
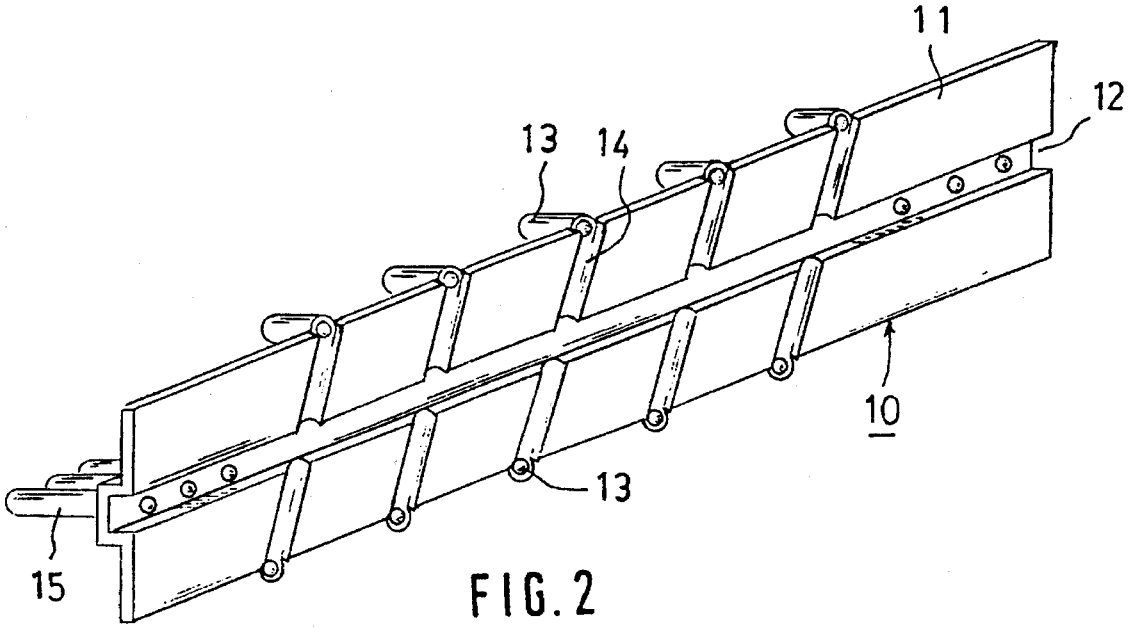
Figure 3:
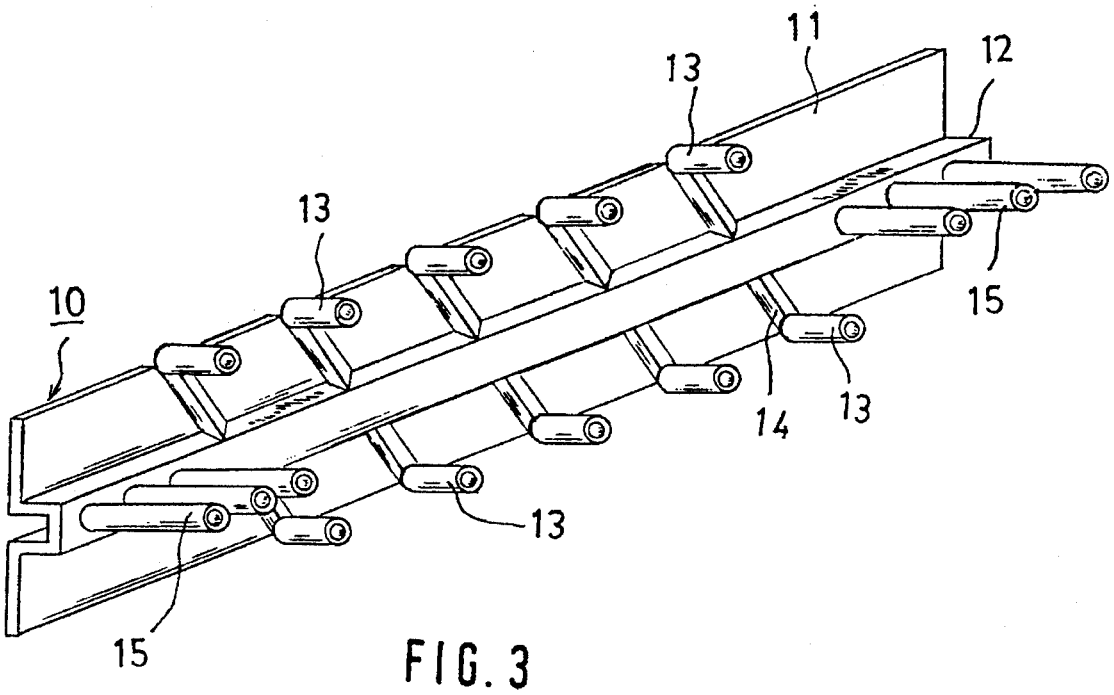

The structures of the bumpers 10, 16 used with the aforementioned racket according to the present invention are illustrated in FIGS. 2 to 6. The bumper 10, depicted in FIGS. 2 and 3, is suited for use at said top portion 4 of the racket. The bumper 10 comprises an elongated substrate 11 provided with a central longitudinal recessed channel 12. The width and depth of the groove 12 corresponds to that of said longitudinal groove 8 on said frame 2. Along opposing longitudinal edges of said substrate 11 are provided a plurality of discrete stringing tubes 13 in pair connected by recessed guide channels 14 formed in said substrate 11. Said guide channels 14 and said longitudinal channel 12 are recessed on the front surface (FIG. 2) and protruded out of the back (FIG. 3). The guide channels 14 have width and depth corresponding to that of the transverse grooves 7 on the outside portion of said frame 2. The diameter of each stringing tube 13 is sized so that it Just snugly fits into each of said transverse grooves 7. On the substrate 11 at the area without the paired stringing tubes 13 is disposed a series of central stringing tubes 15 suspended from said recessed channel 12 which operates in cooperation with the stringing holes 9.

Figure 4:
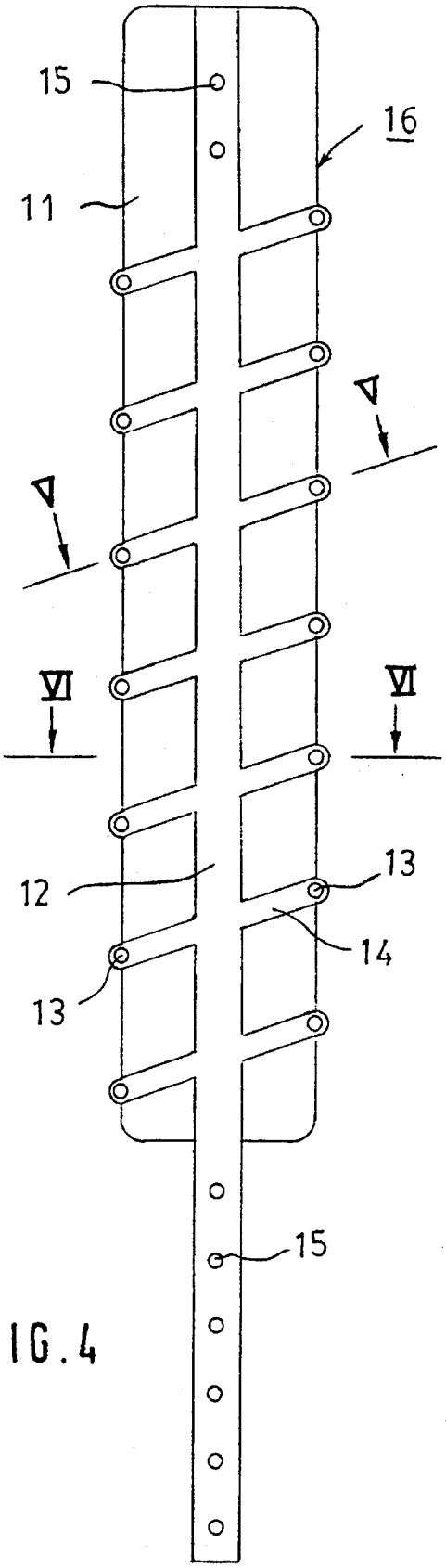
Figure 5:
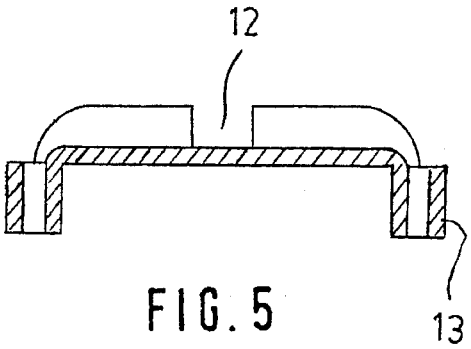
Figure 6:
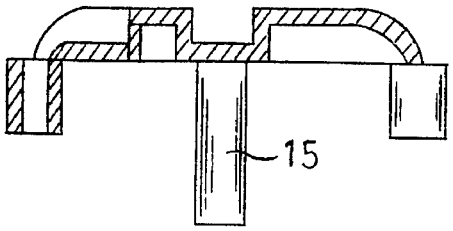
Figure 8:
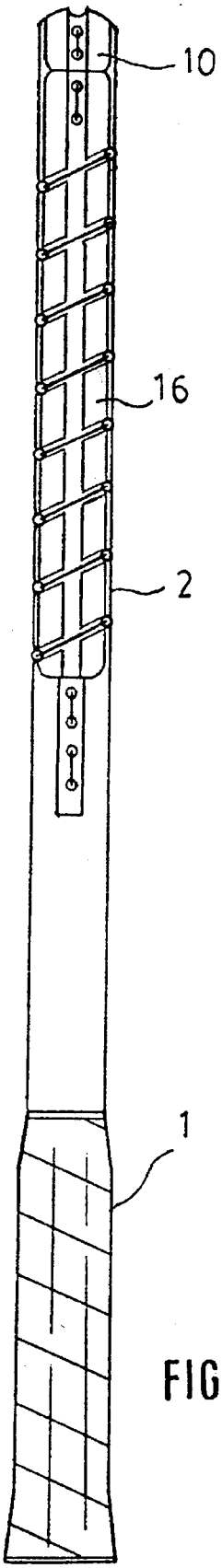
Figure 7:
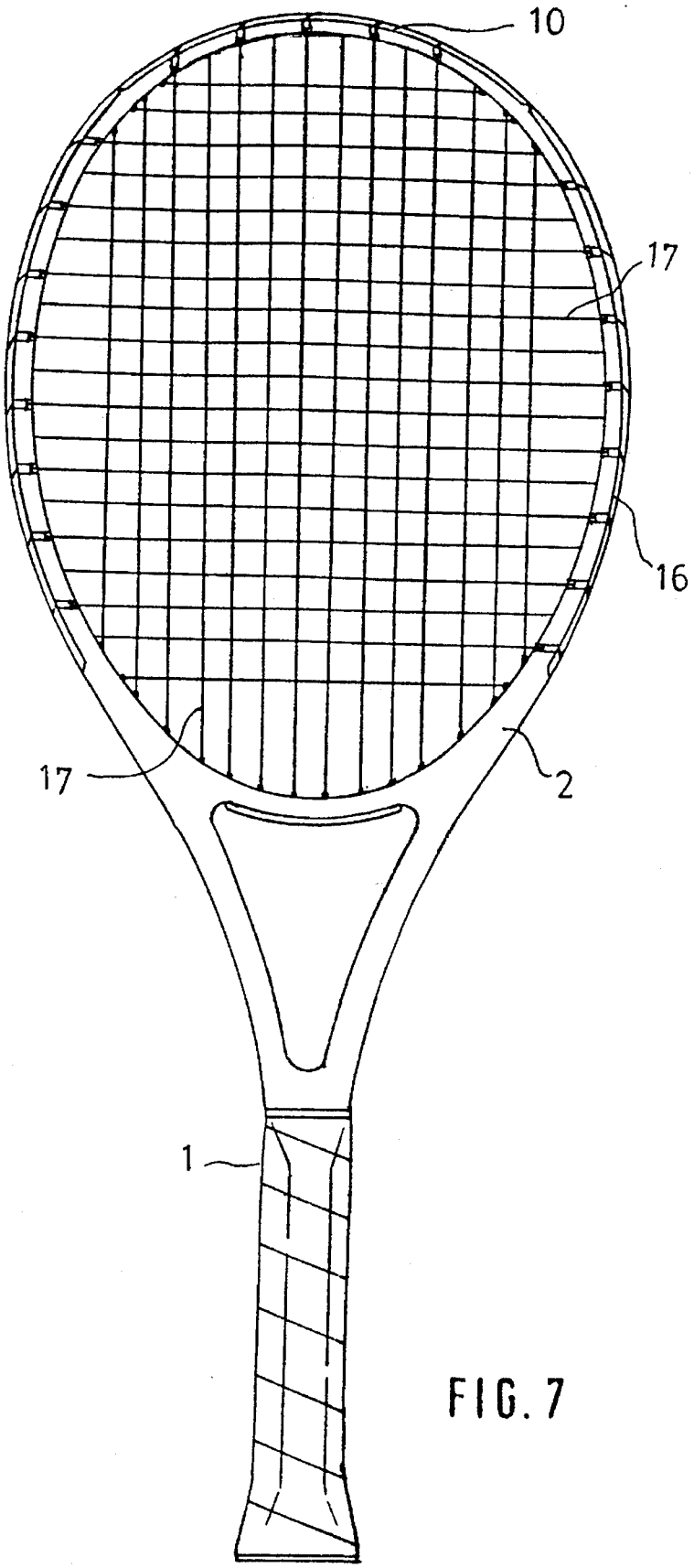

FIGS. 4 through 6 illustrate a bumper 16 to be used for the lateral portions 5, 6 of said frame 2. The arrangement of the substrate 11, longitudinal channel 12, paired stringing tubes 13, connecting guide channels 14 and the series of central stringing tubes 15 are the same as in the bumper 10 used f or said top portion 4, and are indicated with the same reference numbers. But in the illustrated embodiment of FIGS. 4–6, the longitudinal channel 12 at the lower section that is provided with a series of stringing tubes 15 extends out of the substrate 11 like a tongue. In fact, the upper section of said channel 12 may be extended out of said substrate 11 in the same way. The bumper 10 used for top portion 4 as illustrated in FIGS. 2 and 3 as mentioned above may be of the same design.

The present racket has a neat appearance and enhanced rebound characteristics when the bumpers 10 and 16 are mounted thereon. Since the channels 12 and 14 cooperate with the grooves 8 and 7, respectively, the mounting of said bumpers 10 and 16 is reliable and snugly fitted as illustrated in FIGS. 5 and 6.

Figure 10:
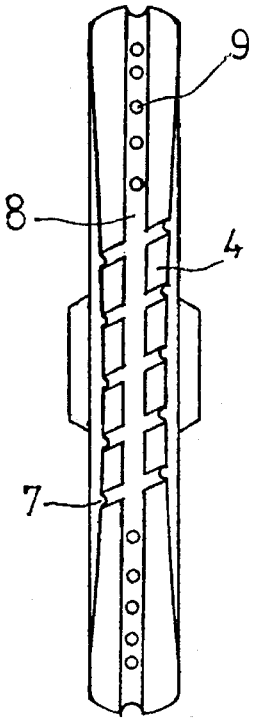
Figure 9:
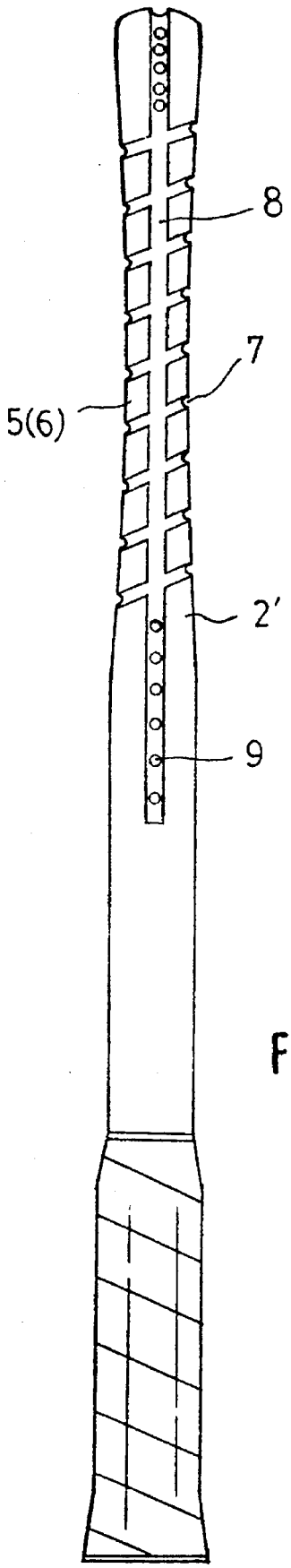

In the alternate embodiment as shown in FIGS. 9 and 10, the frame 2' is slightly concave at the section where the transverse grooves 7 are present. In other words, the thickness of the frame 2' is gradually reduced from a top and toward the center, and then gradually increased toward the bottom of the racket face. Of course, in this variation, the widths of the substrate 11 of said bumpers 10 and 16 are varied correspondingly. Alternatively, the width of said substrate 11 may be kept constant but the location of said paired stringing tubes 13 with respect to the longitudinal edges of said substrate 11 may be displaced inward.

Although the invention has been described in detail with reference to its presently preferred embodiments, it will be understood by the persons skilled in the art that various modifications, changes and variations can be made without departing from the spirit and scope of the invention.

What I claim is:

1. A tennis racket comprising:

a shaft and a substantially elliptical frame having top and opposite lateral portions and a shoulder at each lower end of said lateral portions converging into said shaft, said frame including a striking surface defined by interwoven strings;

wherein said frame is formed with a plurality of transverse grooves at said top and lateral portions, the grooves extending from one face parallel with said striking surface, around the outside of said frame to the opposite face, the grooves terminating in stringing tubes;

the frame further including a single longitudinal groove extending circumferentially at substantially a center line on the outside face of said frame from said shoulder at one of said lateral portions, crossing over all said transverse grooves to said shoulder at the other lateral portion and having series of central stringing holes passing through said frame from said outside to inside surfaces at the sections other than said top and opposite lateral portions, where said transverse grooves are not present, so that the string may pass through the grooves and stringing tubes so that the insertion point of the string through the frame is not always at the central portion of the frame.

2. The racket as set forth in claim 1, wherein:

a bumper comprising multiple portions is mounted on said frame, each portion of the bumper comprising an elongated substrate having a central longitudinal recessed channel and a plurality of discrete stringing tubes in pairs suspended along opposing longitudinal edges of said substrate, with connecting recessed guide channels extended respectively between the two tubes of each pair, and with series of central stringing tubes suspended from said longitudinal recessed channel at the area where said paired stringing tubes are not provided;

the channels corresponding in position to the grooves in the racket frame.

3. The racket as set forth in claim 2, wherein said central longitudinal channel and connecting guide channels are both recessed on the front side of said substrate and simultaneously protrude out of the back side thereof.

4. The racket as set forth in claim 2, wherein said central longitudinal channel at one of or both ends, at the areas where said series of central stringing tubes are located, extends out of a main body of said substrate.

5. The racket as set forth in claim 1, wherein said frame at the section that said transverse grooves are presented is slightly concave.

* * * * *